US011395781B2

(12) United States Patent
Taylor

(10) Patent No.: US 11,395,781 B2
(45) Date of Patent: Jul. 26, 2022

(54) TRANSFER ASSIST PIVOT BOARD

(71) Applicant: Anna Taylor, Liberty Hill, TX (US)

(72) Inventor: Anna Taylor, Liberty Hill, TX (US)

( * ) Notice: Subject to any disclaimer, the term of this patent is extended or adjusted under 35 U.S.C. 154(b) by 125 days.

(21) Appl. No.: 17/096,440

(22) Filed: Nov. 12, 2020

(65) Prior Publication Data

US 2021/0251833 A1 Aug. 19, 2021

Related U.S. Application Data

(60) Provisional application No. 62/978,088, filed on Feb. 18, 2020.

(51) Int. Cl.
*A61G 7/10* (2006.01)

(52) U.S. Cl.
CPC ..... *A61G 7/103* (2013.01); *A61G 7/1046* (2013.01)

(58) Field of Classification Search
CPC ..... A61G 7/103; A61G 7/1046
See application file for complete search history.

(56) References Cited

U.S. PATENT DOCUMENTS 3,043,622 A * 7/1962 Milner ..... A47C 7/14 297/228.12
3,232,662 A * 2/1966 Graves ..... A47G 23/0608 297/240
3,646,896 A * 3/1972 Derujinsky ..... A47B 11/00 5/419
3,713,619 A * 1/1973 Marty ..... A61G 7/1076 248/425
4,659,050 A * 4/1987 Tabayashi ..... F16C 33/588 248/349.1
4,792,188 A * 12/1988 Kawashima ..... B60N 2/146 297/344.21
4,987,621 A * 1/1991 Brantman ..... A61G 7/103 5/81.1 HS
5,079,789 A * 1/1992 Jandrakovic ..... A61G 7/1076 5/81.1 RP
5,282,284 A * 2/1994 Brantman ..... A61G 7/103 5/81.1 HS
5,311,622 A * 5/1994 Allen ..... A61G 7/1076 5/81.1 RP
5,427,426 A * 6/1995 Grappo ..... B60N 2/14 297/212
D390,958 S * 2/1998 Lathrop ..... D24/183
5,735,002 A * 4/1998 Kistner ..... A61G 7/103 5/81.1 HS (Continued)

FOREIGN PATENT DOCUMENTS

GB 2356342 A * 5/2001 ..... A61G 7/103
NL 9101616 A * 4/1993 ..... A61G 7/1076

(Continued)

*Primary Examiner* — David R Hare
*Assistant Examiner* — Alexis Felix Lopez
(74) *Attorney, Agent, or Firm* — Matthew E. Burr

(57) ABSTRACT

A transfer assist board apparatus to facilitate the transfer of a physically challenged person from one location to another has a foot plate rotably connected to a base plate. The perimeter shape of the apparatus is non-circular and has an indentation to provide a space for a care giver to place a foot to step close to the person to assist the transfer. The base plate provides a stop feature to constrain the rotation of the foot plate.

10 Claims, 5 Drawing Sheets

(56) References Cited

U.S. PATENT DOCUMENTS

| | | | | |
|---|---|---|---|---|
| 6,568,646 | B2 * | 5/2003 | Wess | A61G 5/1054<br>248/349.1 |
| 6,938,954 | B1 * | 9/2005 | Hendren | B60N 2/2863<br>297/256.16 |
| 7,159,940 | B1 * | 1/2007 | Atkins | A47C 3/18<br>297/344.26 |
| 2010/0319121 | A1 * | 12/2010 | Polomsky | A61G 7/1076<br>5/81.1 RP |

FOREIGN PATENT DOCUMENTS

| | | | | |
|---|---|---|---|---|
| WO | WO-2005072564 | A1 * | 8/2005 | A47C 9/002 |
| WO | WO-2009073355 | A1 * | 6/2009 | A61G 11/00 |
| WO | WO-2016198447 | A1 * | 12/2016 | |

* cited by examiner

TRANSFER ASSIST PIVOT BOARD

CROSS-REFERENCE TO RELATED APPLICATIONS

This application is related to and claims priority from and the benefit of U.S. provisional patent of the title, application Ser. No. 62/978,088 filed Feb. 18, 2020, the disclosure of which application is incorporated herein by reference.

TECHNICAL FIELD

This disclosure relates generally to a mechanical apparatus to help a care giver transfer a patient from one place to another place, and more particularly to a transfer assist board apparatus that has a pivoting upper plate to facilitate the transfer of a patient from a bed to a chair, for example.

BACKGROUND

A care giver may have to help a patient with mobility challenges such as paraplegia, obesity, or cardiovascular disease to move from a wheel chair to a bed, for example, or vice verse. During such transfers of location, there is always a risk that the patient will fall. Prior solutions provide a lazy susan type of apparatus with a foot plate substantially larger than the base plate and the pivot point in the center. These solutions were typically too small for a physically challenged person to maintain proper body alignment. The circular shape of prior devices prevents a care giver from being close to the person to lend adequate assistance because there no space provided for a care giver's feet to stand close to the apparatus. The lazy susan circular rotation provides no stop feature, which can result in over rotation that complicates the transfer and increases the chances of a fall.

There is an unmet need, therefore, for a solution to reduce the risk of patient harm during a transfer and to enhance a care giver's effectiveness. This problem is sought to be solved here with an apparatus to facilitate the transfer of a patient with a transfer board that has an upper foot plate that pivots on a base plate from an off-center point to rotate the patient to from a first position to a second position, and which provides a stop feature to prevent over rotation. These features reduce the risk of a patient fall and enhance care giver effectiveness.

SUMMARY OF THE INVENTION

It is therefore an aim of the present invention to provide a transfer assist board to reduce the risk of harm to a patient during a transfer. The transfer assist board has a base plate with a non-skid under-layer and a pivoting foot plate rotatably mounted to the base plate. The top surface of the foot plate is also provided with a non-skid surface to inhibit the patient's feet from slipping. Recessed wheels mounted to the under-side of the foot plate allow the the foot plate to smoothly swivel or pivot around a pivot point and along the upper surface of the base plate. Stops are provided to constrain the swivel of the foot plate so that it the swivel is limited to a first position and a second position.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The following discussion is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment. Drawings are not necessarily to scale or in proportion where needed to clearly illustrate a feature.

In the following discussion and in the claims, the terms "including" and "comprising" are used in an open-ended fashion, and thus should be interpreted to mean "including, but not limited to." Also, the term "connect" or "connected" where used if at all is intended to mean either an indirect or direct connection. Thus, if a first component connects to a second component, that connection may be through a direct connection or through an indirect connection via other components and connections.

Certain terms are used throughout the following description and claims to refer to particular system components and method steps. As one skilled in the art will appreciate, different companies may refer to a component by different names. This document does not intend to distinguish between components that differ in name but not function.

Figure 1:
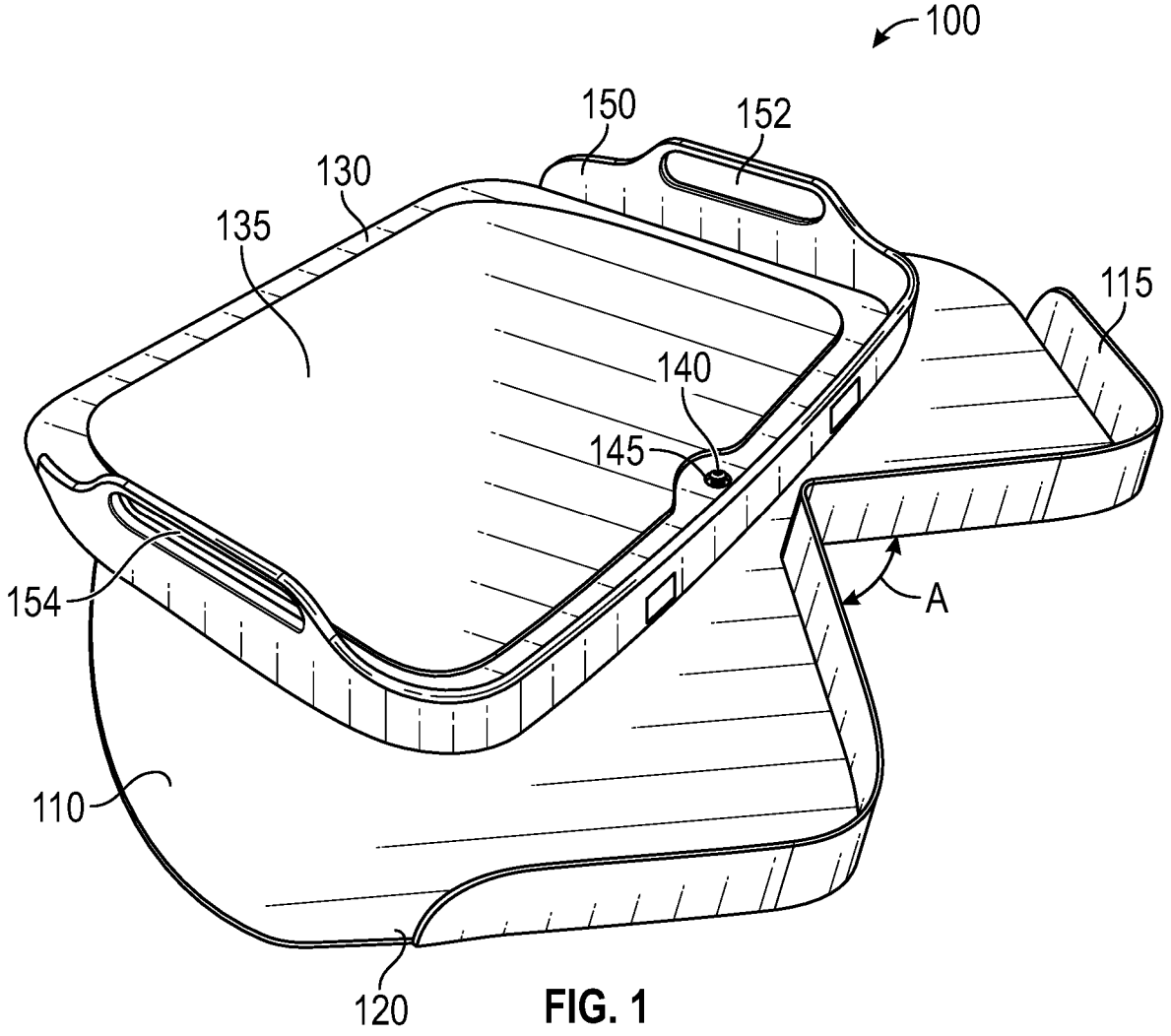
FIG. 1 is a vertical isometric side view diagrammatic illustration of an exemplary embodiment of a transfer assist apparatus of the present disclosure.

Refer now to FIG. 1. FIG. 1 is a vertical isometric side view diagrammatic illustration of an exemplary embodiment of a transfer assist apparatus of the present disclosure. A transfer assist board 100 consists of a base plate 110, preferably made of steel, with a rubber or other suitable non-skid material underlay 310. Base plate 110 has raised edging 115 that lines the top portion 120 of base plate 110 to act as a stopper during rotation of foot plate 130. Base plate 110 is shaped to provide a concave indentation with edges that form an angle A, preferably of 90°, around which angle foot plate 130 swivels during operation of the apparatus.

Foot plate 130 rests on top of base plate 110 and is secured in place by a barrel 140 that is affixed to the top of base plate 110 to create a pivot point. A hole 145, preferably having a bearing (not shown), through foot plate 130 is disposed around the circumference of barrel 140 on base plate 110. A screw 510 is threaded through hole 145 on foot plate 130 to pivotally secure foot plate 130 to base plate 110. Accordingly, foot plate is able to pivot, rotate or swivel easily around the pivot point on roller wheels which roll on the top surface of base plate 110.

Figure 2:
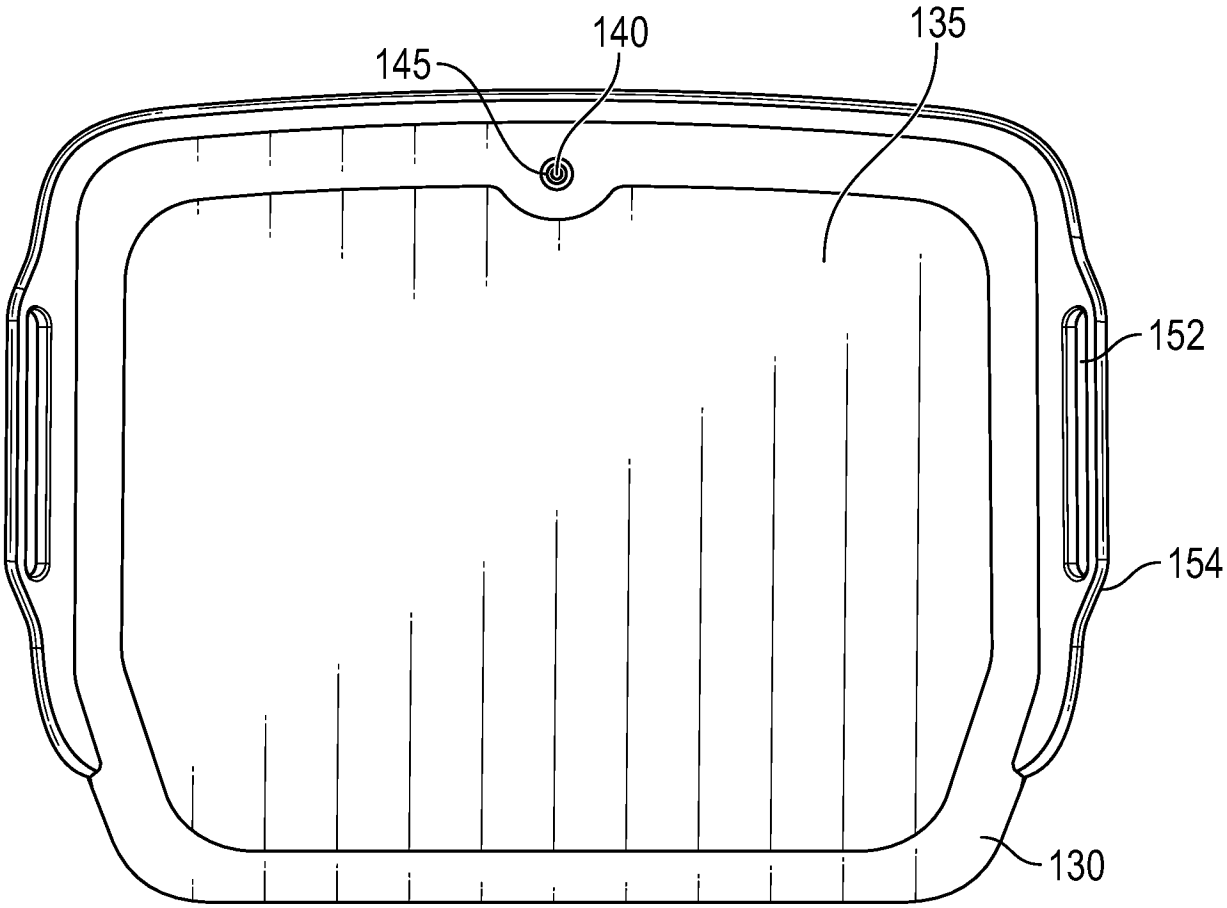
FIG. 2 is a top view diagrammatic illustration of an exemplary embodiment of a foot plate of the transfer assist apparatus of FIG. 1

FIG. 2 is a top view diagrammatic illustration of an exemplary embodiment of a foot plate of the transfer assist apparatus of FIG. 1. Foot plate 130 is preferably made of aluminum, has a rubber or other suitable nonskid lining 135 on the top of the plate, and has raised edging 154 around the top and sides of the plate, which acts to keep one's feet from slipping off of the foot plate 130. The edging also has an opening 152 on each side of foot plate 130 to act as handles, to lift the device. Barrel 140 is threadedly disposed in hole 145.

Figure 3:
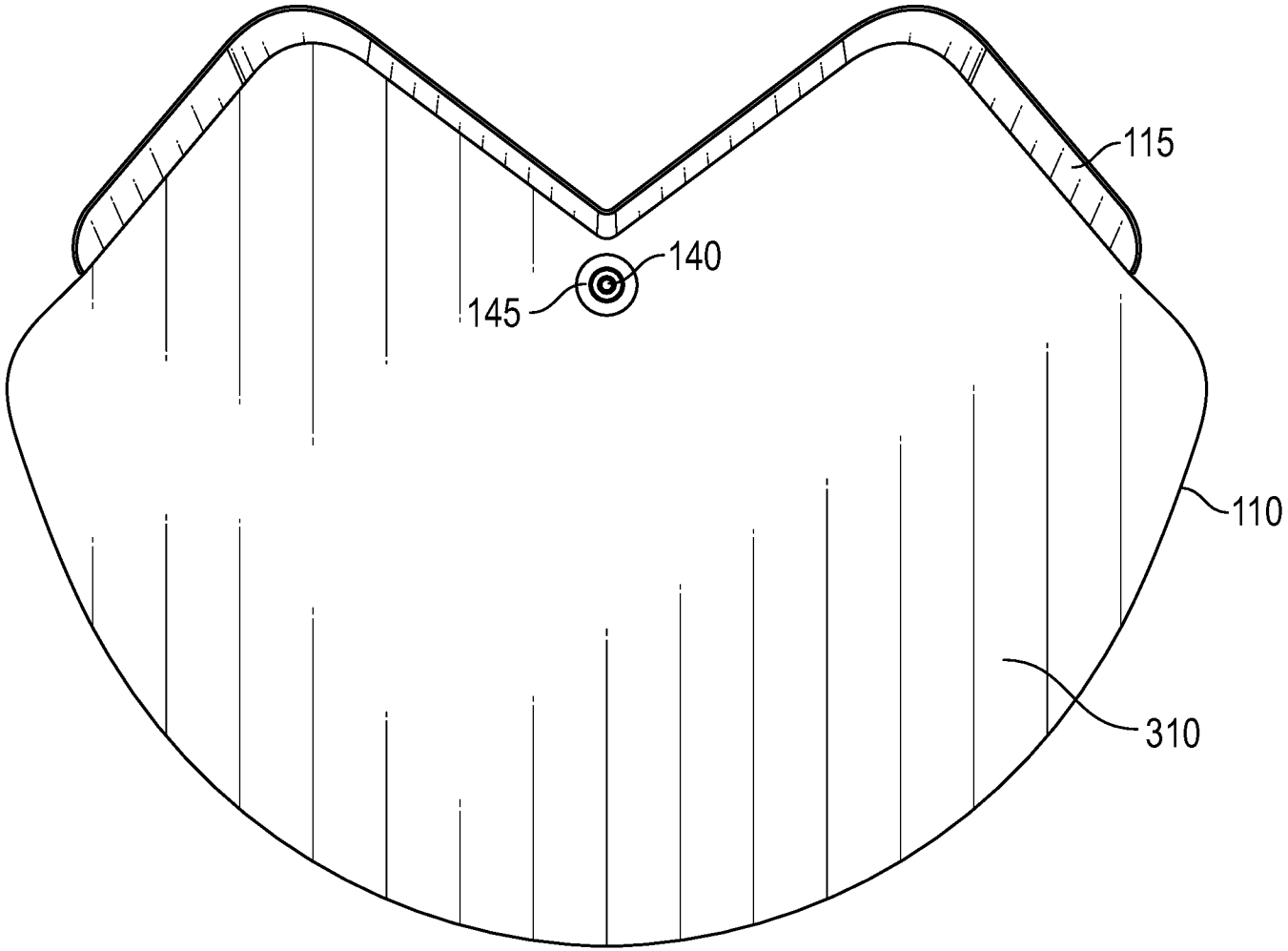
FIG. 3 is a top view diagrammatic illustration of an exemplary embodiment of a base plate of the transfer assist apparatus of of FIG. 1.

FIG. 3 is a top view diagrammatic illustration of an exemplary embodiment of a base plate of transfer assist apparatus of of FIG. 1. The edging 115 on the base plate 110 acts to stop the circular rotation of the foot plate to a total of 90 degrees, preferably, from one end of the rotation to the other. At least a portion of the bottom surface of base plate 110 has a non-skid layer 310 to reduce inadvertent skidding of the base plate during operation of the apparatus. Barrel 140 is threadedly disposed in hole 145 to pivotally connect base plate 110 to foot plate 130.

Certain alternative exemplary embodiments provide a base plate 110 that is larger than foot plate 130. That is, it's perimeter extends beyond the perimeter of the footplate 130. The larger perimeter endows enhanced stability to the apparatus, particularly in comparison to prior lazy susan type devices where the base plate and the foot plate are circular with essentially the same circumference.

While the base plate 110 is made preferably of steel, exemplary alternative embodiments may have a base plate of some other suitably strong material such as of aluminum or plastic, for example.

Figure 4:
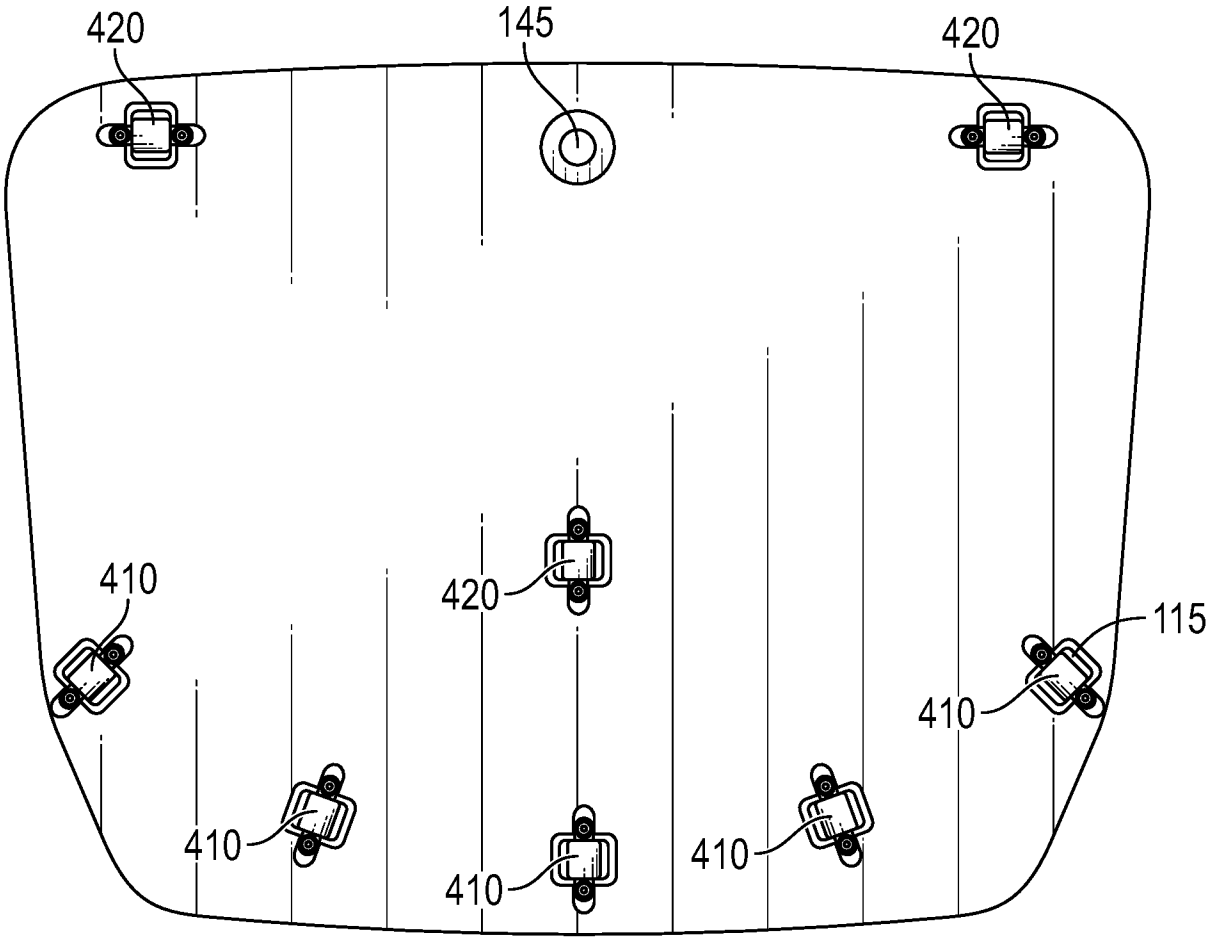
FIG. 4 is a bottom view diagrammatic illustration of an exemplary embodiment of the foot plate of the transfer assist apparatus of FIG. 3.

FIG. 4 is a bottom view diagrammatic illustration of an exemplary embodiment of the foot plate of the transfer assist apparatus of FIG. 3. The foot plate 130 has an array of partially recessed roller wheels 410 on the underside. Partially recessing the wheels advantageously gives the wheels a relatively low profile. Pockets 415 in the same shape of the wheel 410, are present under each wheel 410 to allow the wheels to be partially recessed. Each of the roller wheels 410 are attached to the underside of the foot plate via two small screws 610*a*/610*b*. The wheels 410 are aligned in an arced shape on the underside bottom of the foot plate to allow the foot plate to rotate about the base plate in a arcuate motion.

The pivot point of the foot plate is at top of the foot and base plate, at the location of the barrel 140 and hole 145. There are three additional stabilizing wheels 420, one in the center of the base plate, and two at the top on either side of the barrel.

The wheels 410 are preferably made of steel or some other suitably metal. Exemplary alternative embodiments, however, provide wheels of durable plastic, teflon, resin, composites, and the like, provided that the material is suitable to withstand the forces to which the wheels are subjected.

Figure 5:
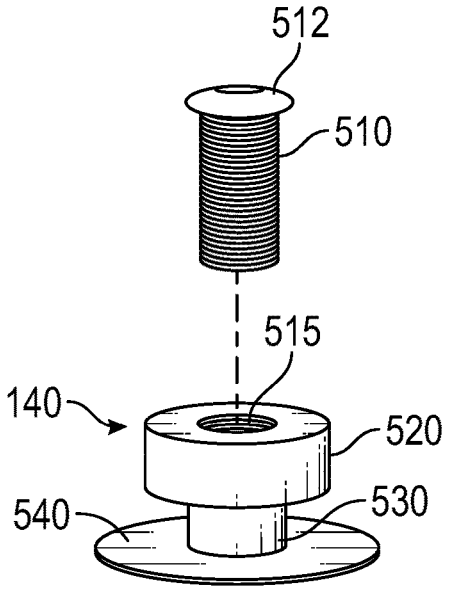
FIG. 5 is an exploded side view of an exemplary embodiment of a barrel and screw assembly to connect the top plate and base plate of a transfer assist board of the present invention.

FIG. 5 is an exploded side view of an exemplary embodiment of a barrel and screw assembly to connect the foot plate and base plate of a transfer assist board of the present invention. Barrel 140 consists of collar portion 520, axel portion 530 and base portion 540. Threaded hole 515 traverses collar 520, axel 530 and base 540. Screw 512 has a threaded stem 510 which threadedly mates with barrel hole 515.

Figure 6:
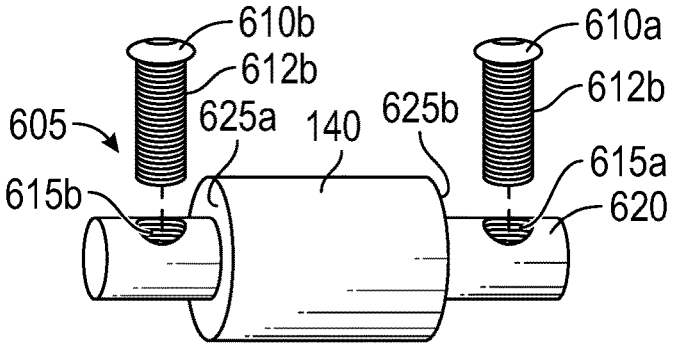
FIG. 6 is an exploded front view of an exemplary embodiment of a wheel assembly of a transfer assist board of the present invention.

FIG. 6 is an exploded front view of an exemplary embodiment of a wheel assembly 605 of a transfer assist board of the present invention. Wheel 140 has two terminal sides 625*a*/625*b* opposite of each other and is rotatably disposed around axel 620. Axel 620 extends for a length beyond each of the terminal sides 625*a*/625*b* of wheel 140. Threaded holes 615*a* and 615*b* receive screws 610*a*/610*b* via threaded stem portions 612*a*/612*b*, respectively to fasten wheel assembly 605 to the underside of base plate 110.

Figure 7:
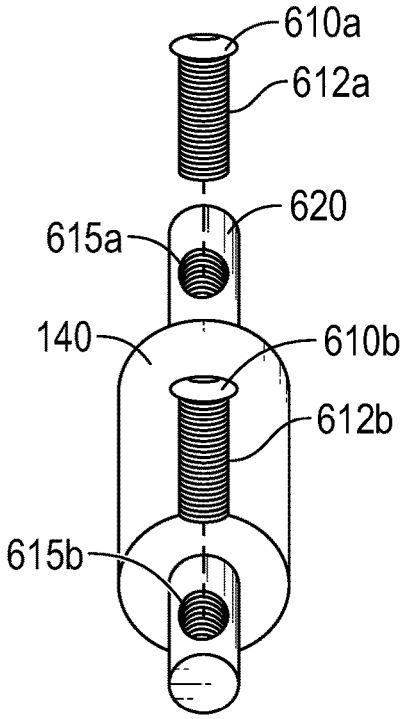
FIG. 7 is an exploded side perspective view of an exemplary embodiment of the wheel assembly of a transfer assist board of FIG. 6.

FIG. 7 is an exploded side perspective view of an exemplary embodiment of the wheel assembly of a transfer assist board of FIG. 6. Wheel 140 has two terminal sides 625*a*/625*b* opposite of each other and is rotatably disposed around axel 620. Axel 620 extends for a length beyond each of the terminal sides 625*a*/625*b* of wheel 140. Threaded holes 615*a* and 615*b* receive screws 610*a*/610*b* via threaded stem portions 612*a*/612*b*, respectively to fasten wheel assembly 605 to the underside of base plate 110.

The transfer assist board described herein reduces friction under a physically dependent person's feet during a standing or squat pivot transfer. The person is able to maintain proper alignment with their feet under their knees during the transfer process. A care giver is able to be close to the person to provide physical support and assist with the swivel. A stop feature is provided to prevent over rotation. The indented shape of the apparatus provides a space where a care giver can put their feet or a foot so that the care giver can step in close to the patient to lend aid and stability during the transfer.

Many modifications and other embodiments of the transfer assist board described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

I claim:

1. A transfer assist board apparatus, the apparatus comprising:

a base plate with a perimeter edge shape that provides a concave indentation having edges that form an angle, a portion of the perimeter edge being raised to provide a stop, and an eccentrically disposed hole to receive a connector;

a foot plate rotatably disposed on the base plate such that the foot plate is able to engage the stop portion of the base plate, the foot plate having a top surface and a bottom surface, an eccentrically disposed hole corresponding to the eccentrically disposed hole of the base plate to receive the connector, the bottom having a plurality of recesses to house a corresponding plurality of roller wheels, and the foot plate further having at least on handle;

and the connector disposed through the foot plate hole and the base plate hole to rotatably connect the foot plate to the base plate, whereby the foot plate is selectively rotatable on the base plate back and forth between the edges of the indentation angle of the perimeter edge constrained by the base plate stop portion.

2. The transfer assist board apparatus of claim 1, wherein the plurality of recesses includes an arcuate array of recesses around a portion of a perimeter edge.

3. The transfer assist board apparatus of claim 2, wherein the plurality of recesses includes at least one center recess.

4. The transfer assist board apparatus of claim 2, wherein the plurality of recesses includes a recess disposed near a first side of the hole and a recess disposed near the opposite side of the hole.

5. The transfer assist board apparatus of claim 1, wherein the at least one handle comprises a raised portion of the footplate perimeter edge at a first side of the foot plate and a second raised portion of the foot plate perimeter edge on the opposite side from the first side, each raised portion having a finger slot therethrough.

6. The transfer assist board apparatus of claim 1, wherein the connector comprises a barrel.

7. The transfer assist board apparatus of claim 1, wherein one or more of the plurality of roller wheels each comprise an axel.

8. The transfer assist board apparatus of claim 1, further comprising a non-skid surface on the top surface of the foot plate.

9. The transfer assist board apparatus of claim 1, where the base plate has a bottom surface and further comprising a non-skid surface on the bottom surface of the base plate.

10. A transfer assist board apparatus, the apparatus comprising:

a base plate with a nonskid top surface, a perimeter edge shape that provides a concave indentation having edges that form an angle, a portion of the perimeter edge being raised to provide a stop, and an eccentrically disposed hole to receive a connector;

a foot plate rotatably disposed on the base plate such that the foot plate is able to engage the stop portion of the base plate, the foot plate having a non-skid top surface and a bottom surface, an eccentrically disposed hole corresponding to the eccentrically disposed hole of the base plate to receive the connector, the bottom having a plurality of recesses to house a corresponding plurality of roller wheels, the plurality of recesses arranged in an array consisting of at least one center recess and a recess disposed near a first side of the hole and a recess disposed near the opposite side of the hole and an arcuate array of recesses around a portion of a perimeter edge, and the foot plate further having at least one handle comprising a raised portion of the footplate perimeter edge at a first side of the foot plate and a second raised portion of the foot plate perimeter edge on the opposite side from the first side, at least one of the raised portions having a finger slot therethrough;

one or more of the plurality of roller wheels comprising an axel, housed in the plurality of recesses; and the connector comprising a barrel disposed through the foot plate hole and the base plate hole to rotatably connect the foot plate to the base plate, whereby the foot plate is selectively rotatable with the plurality of roller wheels over the base plate back and forth between edges of the indention angle of the perimeter edge constrained by the base plate stop portion.

* * * * *